United States Patent [19]

Lyngsie

[11] Patent Number: 4,782,500

[45] Date of Patent: Nov. 1, 1988

[54] METHOD AND AN APPARATUS FOR COUNTING UNIFORM OBJECTS ON A CONVEYOR

[75] Inventor: Gorm Lyngsie, Birkerod, Denmark

[73] Assignee: De Forenede Bryggerier A/S, Copenhagen, Denmark

[21] Appl. No.: 19,796

[22] PCT Filed: May 1, 1986

[86] PCT No.: PCT/DK86/00045

§ 371 Date: Dec. 23, 1986

§ 102(e) Date: Dec. 23, 1986

[87] PCT Pub. No.: WO86/06526

PCT Pub. Date: Nov. 6, 1986

[30] Foreign Application Priority Data

May 2, 1985 [DK] Denmark ..... 1981/85

[51] Int. Cl.[4] ..... G06M 7/00

[52] U.S. Cl. ..... 377/6; 377/10

[58] Field of Search ..... 377/6, 10

[56] References Cited

U.S. PATENT DOCUMENTS

| | | | |
|---|---|---|---|
| 3,665,444 | 5/1972 | Scott | 377/6 |
| 3,678,254 | 7/1972 | Graff | 377/6 |
| 4,303,851 | 12/1981 | Mottier | 377/6 |
| 4,344,520 | 8/1982 | Czoch et al. | 377/6 |
| 4,528,680 | 7/1985 | Archambeault | 377/6 |

*Primary Examiner*—John S. Heyman

*Attorney, Agent, or Firm*—Ladas & Parry

[57] ABSTRACT

A method and an apparatus for counting uniform objects passing a row of sensors over a conveyor for the objects, in which counting of each object by activating a sensor is ensured by proper spacing of the sensors, prevents double counting of any object by scanning the control circuit respectively for the sensors. An activated sensor then inhibits the control circuit for the sensor or sensors adjacent that activated, which might be activated by the same object.

6 Claims, 4 Drawing Sheets

METHOD AND AN APPARATUS FOR COUNTING UNIFORM OBJECTS ON A CONVEYOR

BACKGROUND OF THE INVENTION

The invention concerns a method of counting uniform objects passing a counting location on a conveyor.

Uniform objects to be counted during conveyance may be, for example, beer bottles, which are conveyed in a brewery between various treatment stations, often in several lanes on the conveyor. The counting of bottles at two or more locations on the conveyor may be used, for example, for controlling the speed of a belt conveyor for the bottles for reducing the noise caused by bottle collisions thereon.

Known counters for this have plural sensors at each location, each of which inhibits the other sensors when activated in counting an object. The inhibition is to prevent a passing object from being counted again by a second one of the sensors, and the geometrical arrangement of the sensors ensures that any passing object will be counted by one of the sensors.

SUMMARY OF THE INVENTION

The object of the invention is to provide a method of the above type which eliminates the uncertainty that may arise when an object passes the sensors exactly halfway between two adjacent sensors.

This object is achieved in that the method scans the sensors and inhibits the sensor or sensors adjacent a count-activating sensor. The scanning ensures that it is always and only the first one of two successive simultaneously activated sensors which has count status.

The scanning frequency must be high enough to ensure that at least one scanning cycle is traversed during the time it takes for an object moving with the highest possible velocity to pass the row of sensors. The scanning process further ensures that two or more groups are never established simultaneously.

The invention also concerns an apparatus having a row of sensors above a conveyor for objects in an electric control circuit for a counter. The control circuit scans sensors and inhibits the second scanned of adjacent, simultaneously activated sensors.

In particular, when cylindrical objects are involved, e.g. beer or mineral water bottles, the certainty of all bottles being counted once and only once may be established in that each sensor of the row of sensors has a detection diameter about half the diameter of the objects and satisfies the condition that there are about twice as many sensors per row as objects.

When, additionally, the control circuit inhibits the one or two sensors adjacent one activated for counting, any first-activated sensor will establish itself either as the central one of a 3-group or as one of a 2-group with the adjacent sensor or sensors inhibited, and each group counts one object. The adjacent groups may overlap, but the overlap must not affect the initiating sensors. An unactivated sensor which is a member of a group may be activated later, but does not count because it is inhibited.

A differentiator and then a half-wave rectifier between the control circuit and counter ensures that it is only the leading flank of the pulses applied by the control circuit which activates the counter. As a result, there will always be a minimum time interval between two counter activations, corresponding to the time interval between two successive scanning pulses.

BRIEF DESCRIPTION OF THE DRAWING

The invention will be described more fully below with reference to the drawing, in which.

DESCRIPTION OF THE PREFERRED EMBODIMENT

Figure 1:
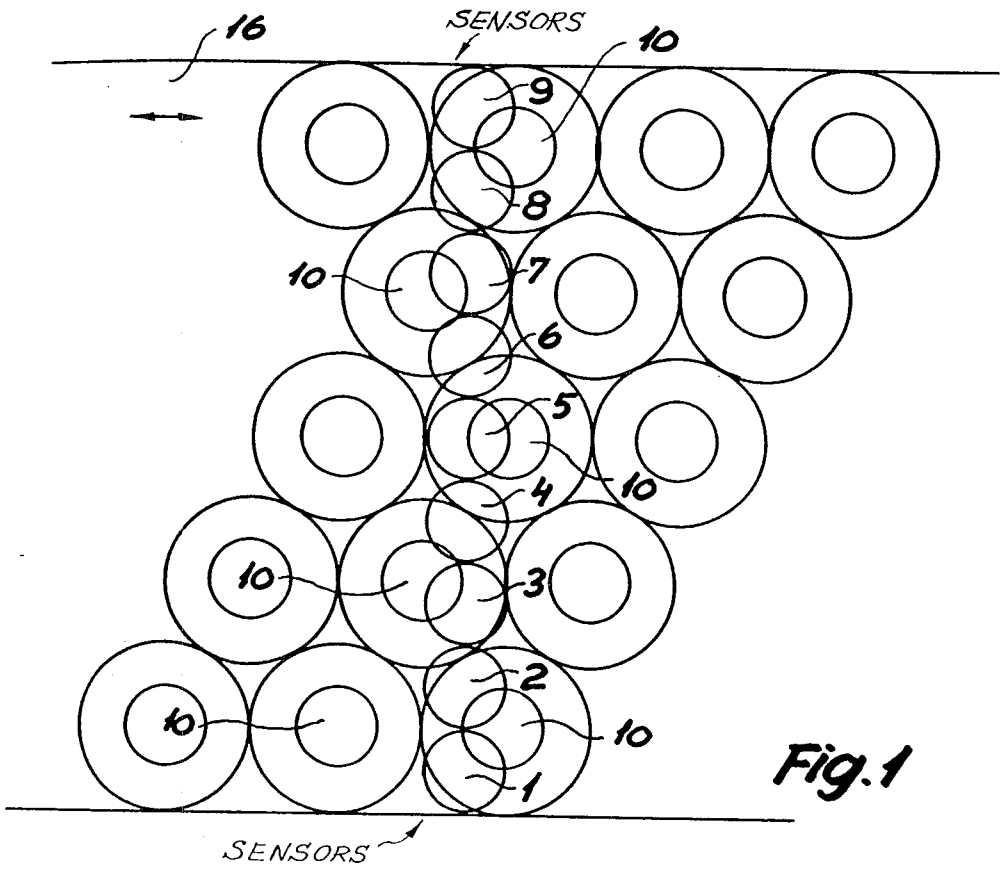
FIG. 1 is a schematic plan view of a plurality of sensors over a conveyor on which uniform, cylindrical objects are packed as densely as possible, FIG. 2 an electrical schematic of a portion of a preferred embodiment of an apparatus according to the invention.

FIG. 1 shows a sensor assembly consisting of a row of sensors 1–9 over a conveyor 16 conveying a plurality of uniform objects 10. The objects are bottles in a typical use of the present invention.

The sensors 1–9 are so designed that their detection areas touch each other. This means that an object on the conveyor might be able to activate more than one sensor when passing the sensor assembly on the conveyor.

With a view to determining accurately that an object passes the assembly, the sensors are scanned sequentially. When, upon scanning to a sensor, it is activated by an object, then the one or two sensors adjacent it are inhibited, the former if it is one of the outer sensors 1 and 9 which is activated. This makes it certain that a passing object is recognized only once, thereby enabling accurate counting of the passing objects.

Thus, upon recognition of objects, groups of inhibited sensors are formed. The groups may consist of two or three sensors and may include sensors common to other groups; however, the sensor initiating the formation of a group can only be a member of one group.

The sensor groups thus formed are cancelled when no sensor in the group is activated any longer, which means that the activating object is now outside the detection area of the sensors.

Figure 2:
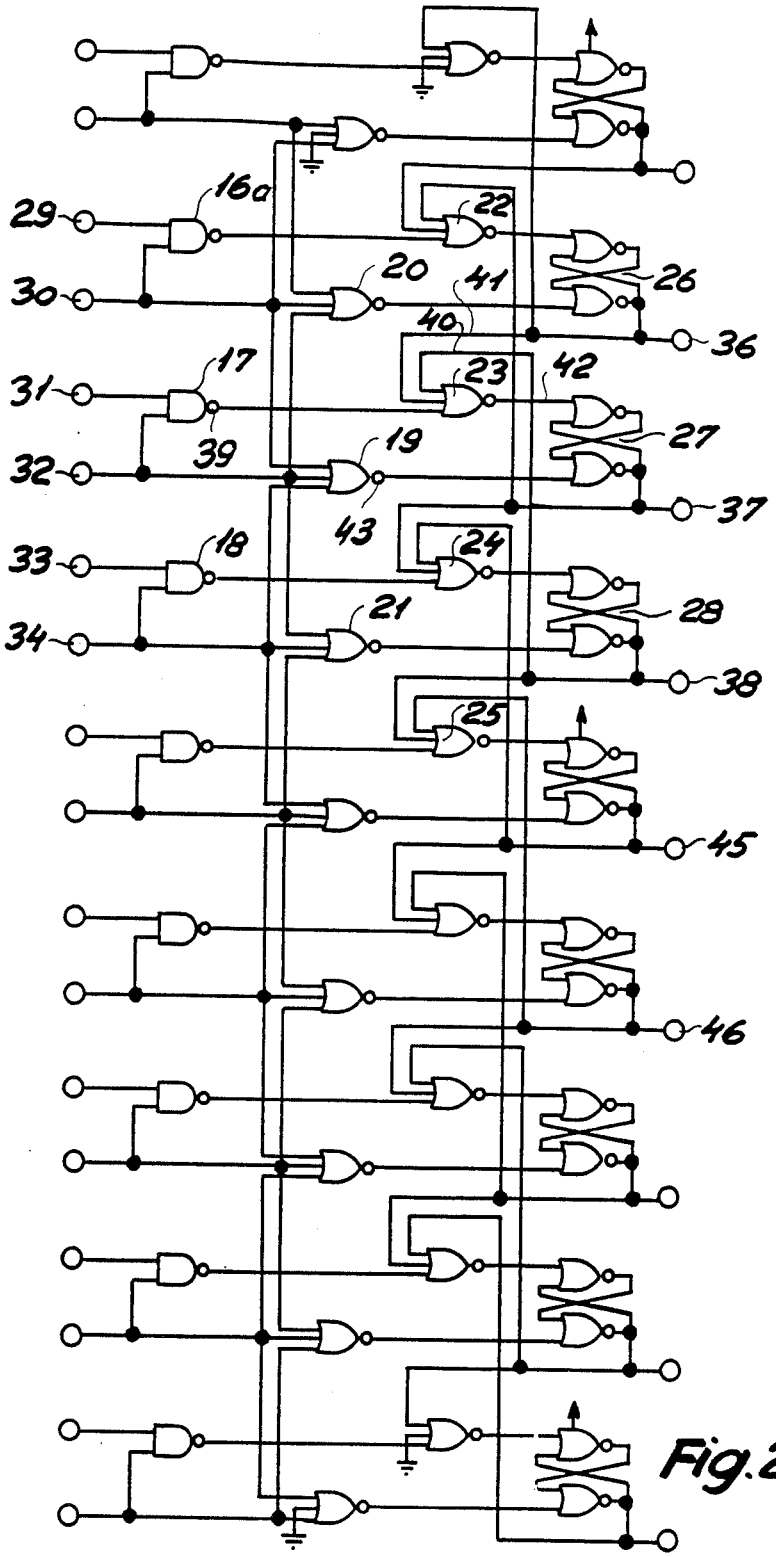

FIG. 2 shows the part of the apparatus of the invention which scans the sensors 1–9 and divides these into groups when an object passes the sensor assembly. The function of the circuit shown in FIG. 2 will be explained now, it being assumed that only one sensor is activated in a scanning period; this assumption just serves to simplify the description.

The sensors are scanned in that a scanning pulse is applied to signal inputs 29–31–33 of NAND gates **16*a*, 17, 18 of the circuit in succession. A sensor output signal has also been transmitted to inputs 30–32–34 of the NAND gates. If it is assumed that the sensor signal on the input 32 is logic "high", i.e. the sensor has recognized an object, and that the input 31 is switched to a logic "high" by the scanning signal, the output 39 of the gate 17 will be logic "low". This output signal is transmitted to a NOR gate 23. If the other inputs 41 and 40 of this gate are both logic "low", the output 42 of the gate 23 will switch to logic "high", and, with this to a flip-flop 27, the output 37 of the flip-flop 27 will then assume the value of a logic "high". In this way, the circuit transmits information about recognition of an object. Inhibition of the adjacent sensors of the activated sensor takes place in that the "high" output signal on the output 37 is directed to gates 22 and 24, which thus inhibit flip-flops 26 and 28. A group is formed in this way around the sensor connected to the input 32 when its adjacent sensors are connected to the inputs 30 and 34**, respectively.

A group formed in the manner described above is cancelled when all the sensors forming part of the group are no longer activated by the object. This means that the inputs 30, 32, 34 are at the "low" level, and thus all the inputs of the gate 19 are on "low" so that its output 43 will be "high"; this signal resets the flip-flop 27 whose output switches to "low", which removes the inhibition of the flip-flops 26 and 28. All output signals 36, 37, 38, 44, 45, 46, 47, 48, 49 from the sampling and group forming circuit shown in FIG. 2 are transmitted to the circuit shown in FIG. 3.

Figure 3:
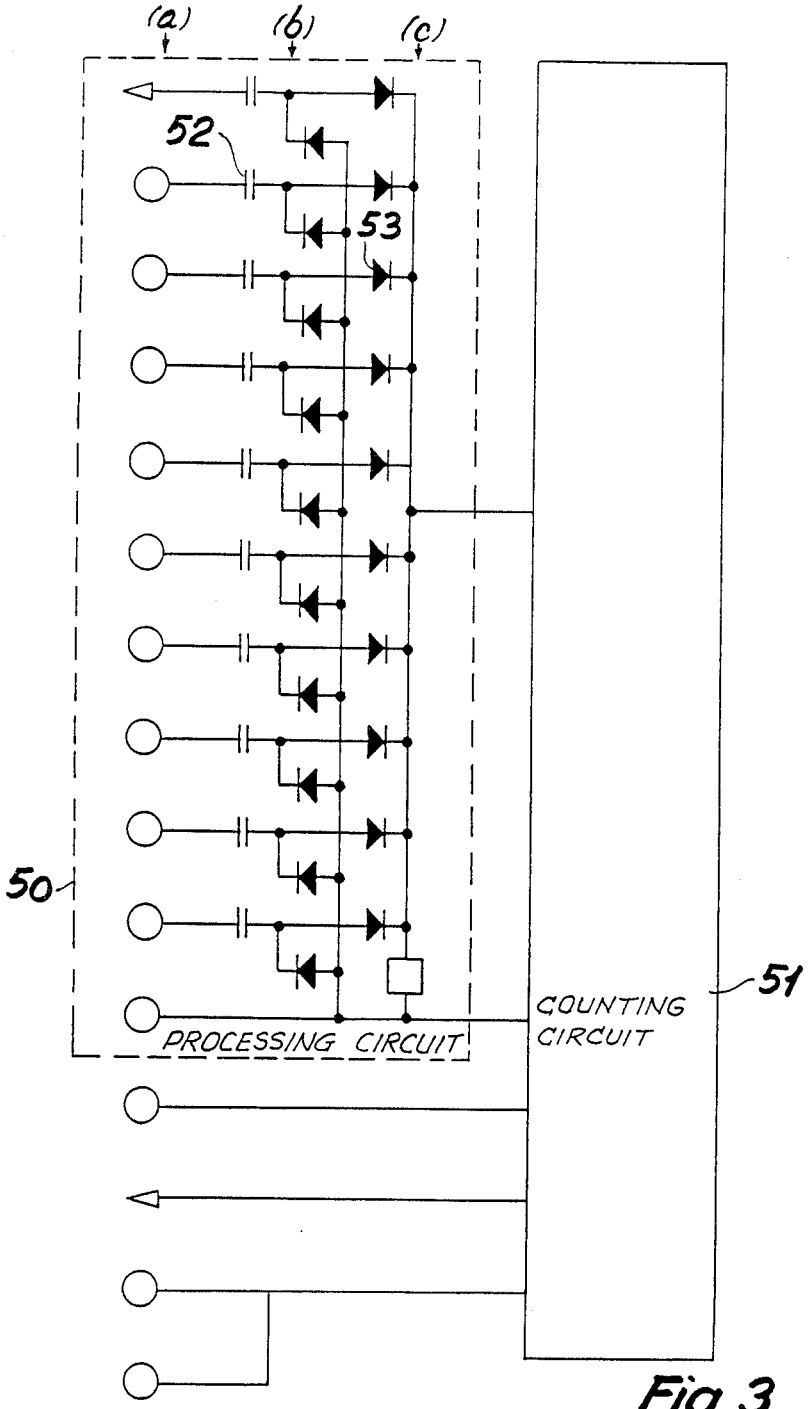
FIG. 3 is a block diagram of another display-unit portion of the preferred embodiment.

The circuit shown in FIG. 3 comprises an input signal processing circuit 50 and a counting circuit 51. The counting circuit is of a conventional type and will not be described in detail.

Figure 4:
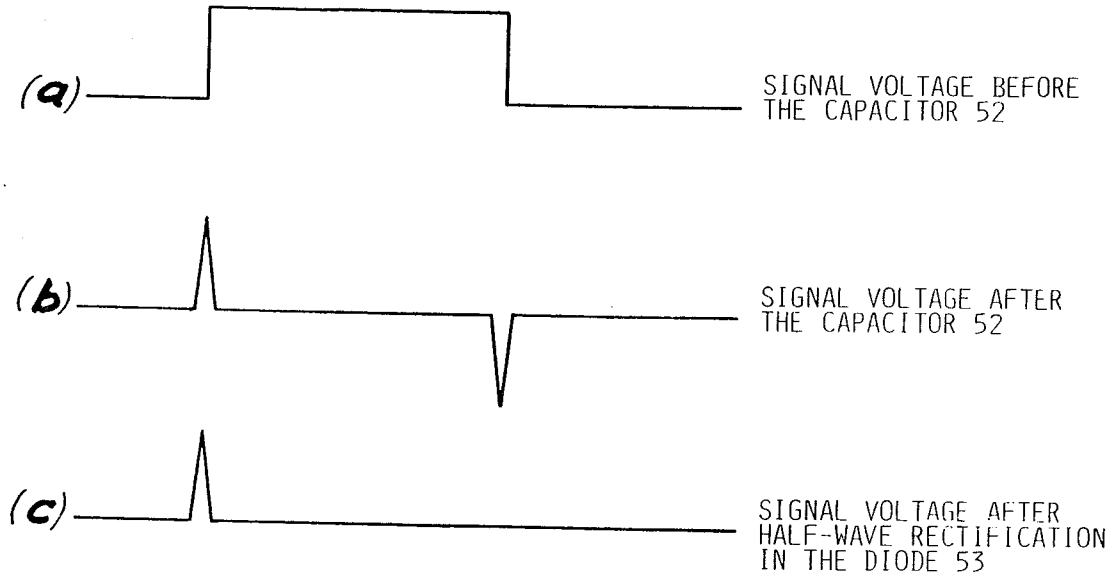
FIG. 4 shows single wave forms in a signal processing circuit which forms part of the display unit shown in FIG. 3.

The purpose of the signal processing circuit 50 is to convert the pulse signals arriving from the signal outputs 36–38, 44–49 to a form of pulse signals which are more distinctly spaced from each other in terms of time. In FIG. 4, it is shown with the reference letter a that the input signal to the signal processing circuit 50 is a square signal. Since such a signal would block the counter for other signals, the signal is differentiated with a capacitor 52, resulting in the wave form shown with the reference letter b. This signal is half-wave rectified with a diode 53, resulting in the wave form shown with the reference letter c. It will be seen that this signal processing has the effect that it is only the leading edge of the pulse signal from the sampling and group formation circuit which affects the counting circuit 51. This is an important property of the present circuit because if is the group formation moment of time which expresses when an object has been recognized, whereas the moment of time has no importance for the counting. Further, the signal processing circuit 50 serves to ensure that no signals block others.

The sensors described in the foregoing may be of an inductive, optical or any other type where the scanning area is well-defined. Thus, it is possible to use a pattern recognition system to scan the position of the objects on the conveyor. Such a solution would require the presence of a television camera or other optical signal receiver over the conveyor, and processing of the output signal from it in such a manner that the abovementioned groups may be formed and cancelled.

It is clear that the shown, preferred embodiment of the scanning and group formation unit, and of the signal processing and counter unit, may be replaced by any form of a logic network capable of performing these functions.

I claim:

1. In a method of counting uniform objects passing a row of sensors in non-contact relation thereto over a conveyor for the objects, each of the sensors being able to detect the presence of any of the objects within a predetermined detection area, the detection areas of adjacent ones of the sensors at least touching each other, the sensors operating a counter through a control circuit interconnected in such a manner that activation of a first of the sensors by one of the objects inhibits the control circuit for a group of others of the sensors which might be activated by the same one of the objects, the improvement comprising:

scanning the control circuit respectively for the sensors, and, upon activation of one of the sensors, inhibiting the control circuit for the sensor or sensors adjacent to that one of the sensors whereby only one count pulse per object is permitted.

2. In an apparatus for counting uniform objects passing a row of sensors over a conveyor for the objects with such mutual spacing between the sensors that any of the objects will always activate at least one of the sensors and having a control circuit for operating a counter in response to the activated sensor, the control circuit responding to a first activated one of the sensors by inhibiting the control circuit for a group of others of the sensors which might be activated by the same object, the improvement comprising:

scanning means for scanning the control circuit respectively for the sensors and inhibiting means for inhibiting the control circuit with respect to the sensor or sensors adjacent to an activated one of the sensors whereby only one pulse per object is permitted.

3. The apparatus according to claim 2, wherein the row of sensors is substantially perpendicular to the conveyor and contains at least $N=2p-1$ sensors, where p is the number of objects in a densely packed transverse row on the conveyor.

4. The apparatus according to claim 3, wherein the interconnection of the control circuit is so arranged that the control circuits of the two adjacent sensors of an activated sensor or the control circuit of the adjacent sensor if the activated sensor is an outer sensor, are/is inhibited.

5. The apparatus according to claim 2, and further comprising differentiation circuits followed by half-wave-rectifiers interposed between the control circuit and a counter.

6. An apparatus for counting uniform objects passing a counting location on a conveyor, comprising:

(a) a row of sensors in non-contact relation with said objects and placed over a conveyor for uniform objects with such mutual spacing that any one of the objects passing the row of sensors on the conveyor will always activate at least one of the sensors;

(b) a counter;

(c) a control circuit connecting the sensors to the counter so as to operate the counter when any of the sensors is activated; and (d) scanning means for scanning the control circuits respectively for the sensors, the control circuit inhibiting the sensor or sensors adjacent to an activated one of the sensors from operating the counter whereby only one count pulse per object is permitted.

* * * * *